US005433440A

United States Patent [19]

Lin

[11] Patent Number: 5,433,440

[45] Date of Patent: Jul. 18, 1995

[54] GOLF CLUB HEAD

[75] Inventor: Shih-An Lin, Ping-Tung, Taiwan

[73] Assignee: Rocs Precision Casting Co., Ltd., Ping-Tung, Taiwan

[21] Appl. No.: 357,919

[22] Filed: Dec. 16, 1994

[51] Int. Cl.[6] ..... A63B 53/04; B22D 17/00

[52] U.S. Cl. ..... 273/78; 273/167 H; 273/173; 29/527.5

[58] Field of Search ..... 273/167 R, 77 R, 167 H, 273/173, 167 J, 78, 174, 169, 167 F, 79; 29/527.5

[56] References Cited

U.S. PATENT DOCUMENTS

| | | | |
|---|---|---|---|
| 3,211,455 | 10/1965 | Hyden | 273/78 |
| 3,226,120 | 12/1965 | Borah | 273/78 |
| 4,417,731 | 11/1983 | Yamada | 273/167 H |
| 4,465,221 | 8/1984 | Schmidt | 273/173 |
| 5,028,049 | 7/1991 | McKeighen | 273/167 J |
| 5,106,094 | 4/1992 | Desbiolles | 273/173 |
| 5,176,384 | 1/1993 | Sata | 273/78 |
| 5,261,664 | 11/1993 | Anderson | 273/78 |
| 5,271,621 | 12/1993 | Lo | 273/78 |
| 5,303,922 | 4/1994 | Lo | 273/167 J |
| 5,310,185 | 5/1994 | Viollaz | 273/78 |

*Primary Examiner*—Sebastiano Passaniti

[57] ABSTRACT

A golf club head includes a face plate which is made of a first metal material, and a head body which is made of a second metal material with a melting point lower than that of the first metal material. The face plate has a front side formed with a hitting surface, a rear side opposite to the front side, a flange projecting from a periphery of the face plate adjacent to the rear side, and a shoulder formed on the periphery of the face plate along and anterior to the flange. The head body has a front portion which has a recess formed therein for receiving the face plate, a peripheral edge defining the recess, and an engagement portion formed integrally with the front portion in the peripheral edge and engaged intimately and precisely with the flange and the shoulder of the face plate during molding of the head body. The engagement portion has a groove extending along the peripheral edge and engaging the flange of the face plate so as to retain the face plate on the head body to form the golf club head.

7 Claims, 4 Drawing Sheets

GOLF CLUB HEAD

BACKGROUND OF THE INVENTION

1. Field of the Invention

The invention relates to a golf club head, more particularly to a golf club head which consists of a head body and a face plate that are made of different metal materials and that are connected securely to each other while molding the head body in order to enhance durability of the golf club head.

2. Description of the Related Art

Generally, owing to different purposes and functions, several types of golf clubs, such as wood clubs, iron clubs and putter clubs, are available in the market. The main difference of these golf clubs lies in their golf club heads. Accordingly, different casting methods are employed extensively to mold these golf club heads according to their required shapes. For example, an investment casting process can be employed to mold the heads of wood clubs, and a die casting process can be employed to mold the heads of iron clubs or putter clubs. Metal materials are used extensively in molding these golf club heads. At present, titanium is the best metal material for molding the golf club heads since it can provide a good hitting effect. However, titanium is quite expensive. Accordingly, a known golf club head has been developed recently to have only its hitting face plate molded from the titanium in order to reduce the manufacturing cost of the known golf club head.

Referring to FIG. 1, the known golf club head 1 consists of a head body 10 and a hitting face plate 11 which are manufactured respectively by different casting processes, and which are then connected securely to each other by screws or rivets in order to form the known golf club head 1. The hitting face plate 11 is made of titanium. The head body 10 is made of another metal material which has a melting point different from that of the titanium so that welding cannot be employed to mount the face plate 11 to the head body 10 to constitute the known golf club head 1.

However, the hitting face plate 11 may loosen from the head body 10 after long-term use when screws or rivets are employed to mount the hitting face plate 11 on the head body 10. Accordingly, the durability of the golf club head 1 is relatively poor.

SUMMARY OF THE INVENTION

Therefore, the main objective of the present invention is provide a golf club head which consists of a head body and a face plate that are made of different metal materials and that are connected securely to each other when molding the head body in order to improve durability of the golf club head.

According to this invention, a golf club head includes a face plate which is made of a first metal material, and a head body which is made of a second metal material with a melting point lower than that of the first metal material.

The face plate has a front side formed with a hitting surface, a rear side opposite to the front side, a flange projecting from a periphery of the face plate adjacent to the rear side, and a shoulder formed on the periphery of the face plate along and anterior to the flange. The head body has a front portion which has a recess formed therein .for receiving the face plate, a peripheral edge defining the recess, and an engagement means formed integrally with the front portion in the peripheral edge and engaged intimately and precisely with the flange and the shoulder of the face plate during molding of the head body. The engagement means has a groove extending along the peripheral edge and engaging the flange of the face plate so as to retain the face plate on the head body to form the golf club head.

The head body can be molded to form a solid head body or a hollow head body depending on the required shape of the golf club head.

The solid head body is molded by a die casting process which includes the steps of:

(1) placing the face plate in a mold for forming the solid head body;

(2) injecting the second metal material in its molten state into the mold to form the solid head body which has the engagement means formed integrally therewith for engaging the face plate; and (3) removing the solid head body from the mold to form the golf club head.

The hollow head body is molded by a lost wax process which includes the steps of:

(1) placing the face plate in a mold for forming the hollow head body;

(2) injecting molten wax into the mold to form a hollow wax body with the face plate attached thereto;

(3) removing the hollow wax body from the mold;

(4) coating a layer of refractory material on the surface of the hollow wax body to form a refractory mold surrounding the hollow wax body;

(5) injecting the second metal material in its molten state into the refractory mold to replace the hollow wax body with the second metal material, the second metal material forming the hollow head body which has the engagement means formed integrally therewith for engaging the face plate; and (6) removing the hollow head body from the refractory mold to form the golf club head.

BRIEF DESCRIPTION OF THE DRAWINGS

Other features and advantages of the present invention will become apparent in the following detailed description of the preferred embodiments of the present invention, with reference to the accompanying drawings, of which.

DETAILED DESCRIPTION OF THE PREFERRED EMBODIMENTS

Figure 1:
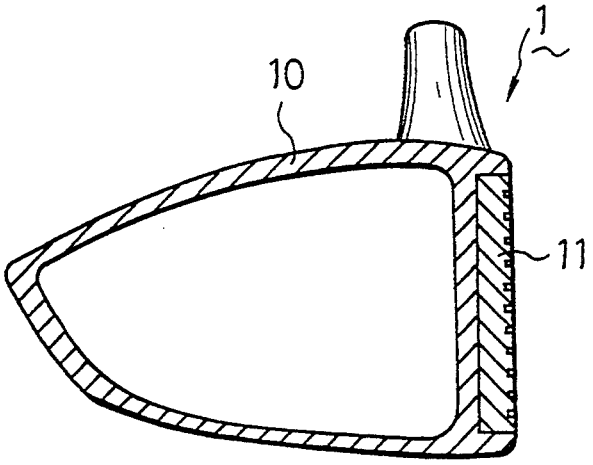
FIG. 1 PRIOR ART
FIG. 1 is a sectional view showing a conventional golf club head.
Figure 2:
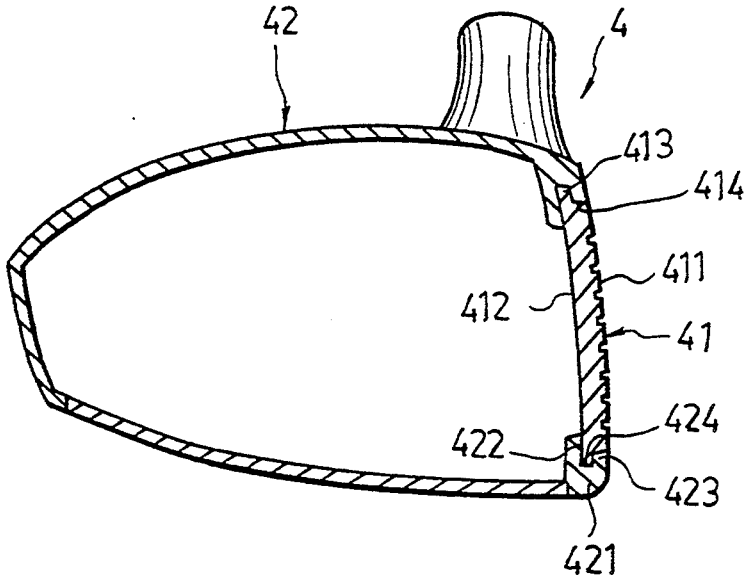
FIG. 2 is a sectional view showing the first preferred embodiment of a golf club head of this invention.

Referring to FIG. 2, the first preferred embodiment of a golf club head 4 of this invention is shaped so as to be applied to a wood club. The golf club head 4 includes a face plate 41 which is made of a first metal material, and a hollow head body 42 which is made of a second metal material with a melting point lower than that of the first metal material.

In this embodiment, the first metal material can be titanium with a melting point of about 1700° C., or stainless steel with a melting point of about 1450° C. The second metal material can be copper with a melting point of about 1100° C., or aluminum with a melting point of about 660° C.

The face plate 41 has a front side 411 formed with a hitting surface, a rear side 412 opposite to the front side 411, a flange 413 projecting from a periphery of the face plate 41 adjacent to the rear side 412, and a shoulder 414 formed in the periphery of the face plate 41 along and anterior to the flange 413. The face plate 41 is molded in a known manner.

The hollow head body 42 has a front portion 421 which has a recess 422 formed therein for receiving the face plate 41, a peripheral edge 423 defining the recess 422, and an engagement means formed integrally with the front portion 421 in the peripheral edge 423 and engaged intimately and precisely with the flange 413 and the shoulder 414 of the face plate 41 during molding of the hollow head body 42. The engagement means has a groove 424 extending along the peripheral edge 423 and engaging the flange 413 of the face plate 41 so as to retain the face plate 41 on the front portion 421 of the hollow head body 42 to form the golf club head 4. The recess 422 is communicated with the interior of the hollow head body 42. It is known that, when the face plate 41 is mounted on the hollow head body 42, the hitting surface of the face plate 41 and the front surface of the hollow head body 42 are on a common plane.

The hollow head body 42 is molded by a lost wax process which includes the steps of:

(1) The face plate 41 is placed in a two-layered mold (not shown) which is shaped to fit the face plate 41 and which is used for forming the hollow head body 42.

(2) Molten wax is injected into the two-layered mold to form a hollow wax body with the face plate 41 attached thereto.

(3) The hollow wax body is removed from the two-layered mold in a known manner.

(4) A layer of refractory material is coated on the surface of the hollow wax body in a known manner to form a refractory mold that surrounds the wax body.

(5) The second metal material is injected in its molten state into the refractory mold to replace the wax body with the second metal material. In this way, the second metal material can form the hollow head body 42 which has the engagement means formed integrally therewith for engaging the face plate 41.

(6) The hollow head body 42 is then removed from the refractory mold by smashing the latter, thereby forming the golf club head 4.

Figure 3:
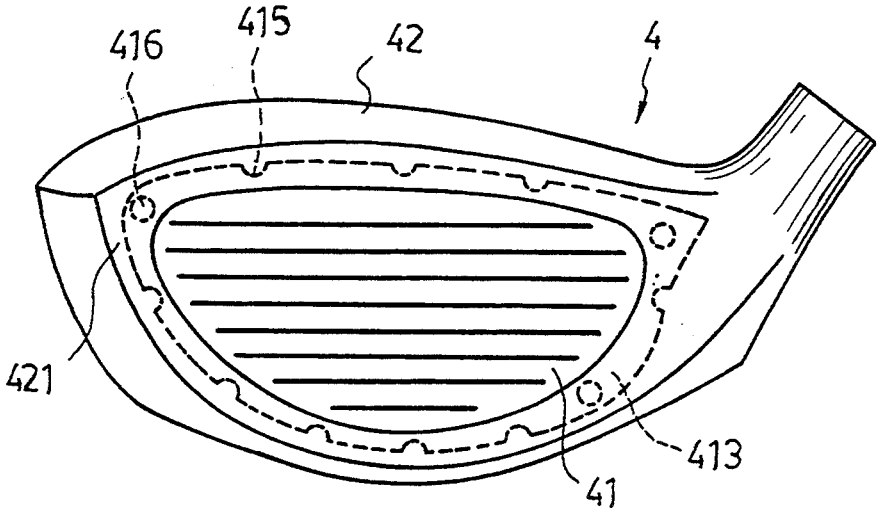
FIG. 3 is an elevational front view showing the golf club head according to the first preferred embodiment of this invention.

Referring to FIG. 3, the flange 413 of the face plate 41 has several holes 416 formed respectively through the large-size portions thereof, and several notches 415 formed in the periphery thereof and located respectively at the smaller-size portions thereof. When molding the hollow head body 42 as described in step (5), the molten second metal material extends through the notches 415 and the holes 416 to constitute several connection portions, which are formed integrally with the front portion 421 of the hollow head body 42, for further retaining the flange 413 of the face plate 41 within the groove 424 (see FIG. 2) of the hollow head body 42. Accordingly, the connection portions can also function as the engagement means of the hollow head body 42. It is noted that the face plate 41 is mounted to the hollow head body 42 by the engagement means when molding the hollow head body 42. In this way, not only can the face plate 41 be secured to the hollow head body 42, assembly of the face plate 41 and the hollow head body 42 can be ensured even after a long-term use.

Figure 4:
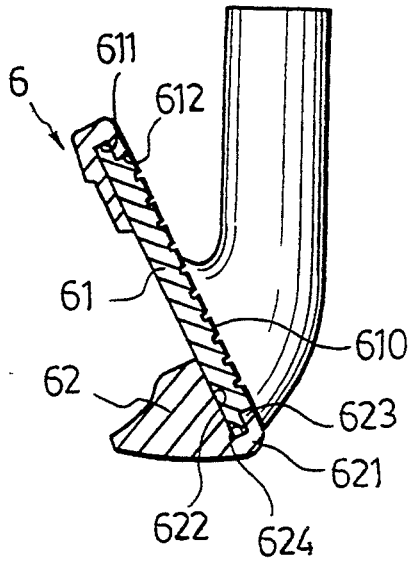
FIG. 4 is a sectional view showing the second preferred embodiment of a golf club head of this invention.

Referring to FIG. 4, the second preferred embodiment of a golf club head 6 of this invention is shaped so as to be applied to an iron club. The golf club head 6 includes a face plate 61 which is made of a first metal material, and a solid head body 62 which is made of a second metal material with a melting point lower than the first metal material. The first and second metal materials are similar to those of the first preferred embodiment.

The face plate 61 is similar to that of the first preferred embodiment and is formed with a hitting surface 610, a flange 611 and a shoulder 612.

The solid head body 62 has a front portion 621 which has a recess 622 formed therein for receiving the face plate 61, a peripheral edge 623 defining the recess 622, and an engagement means formed integrally with the front portion 621 in the peripheral edge 623 and engaged intimately and precisely with the flange 611 and the shoulder 612 of the face plate 61 during molding of the solid head body 62. The engagement means has a groove 624 extending along the peripheral edge 623 and engaging the flange 611 of the face plate 61 so as to retain the face plate 61 on the front portion 621 of the solid head body 62 to form the golf club head 6. The hitting surface 610 of the face plate 61 and the front surface of the solid head body 62 are on a common plane.

The solid head body 62 is molded by a lost wax process which includes the steps of:

(1) The face plate 61 is placed in a mold (not shown) which is shaped to fit the face plate 61 and which is used for forming the solid head body 62.

(2) The second metal material is injected in its molten state into the mold to form the solid head body 62 which has the engagement means formed integrally therewith for engaging the face plate 61.

(3) The solid head body 62 is removed from the mold in a known manner to form the golf club head 6.

Figure 5:
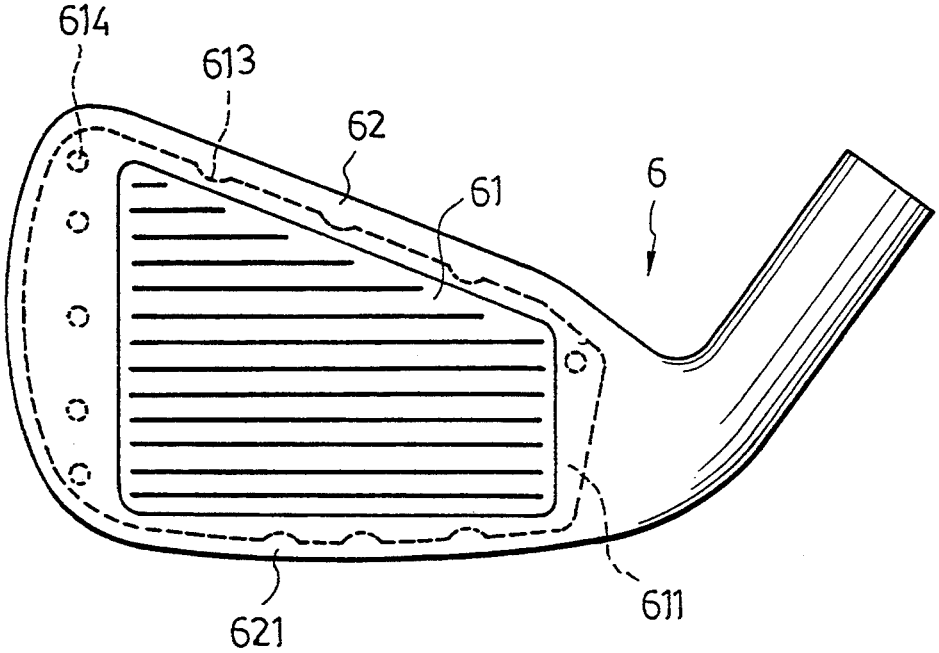
FIG. 5 is an elevational front view showing the golf club head according to the second preferred embodiment of this invention.

Referring to FIG. 5, the flange 611 of the face plate 61 has several holes 614 formed respectively through the large-size portions thereof, and several notches 613 formed in the periphery thereof and located respectively at the smaller-size portions thereof. When molding the solid head body 62 as described in step (2), the molten second metal material extends through the notches 613 and the holes 414 to form several connection portions, which are formed integrally with the front portion 621 of the solid head body 62, for further retaining the flange 611 of the face plate 61 within the groove 624 (see FIG. 4) of the solid head body 62. Therefore, the connection portions can also function as the engagement means of the solid head body 62.

Figure 7:
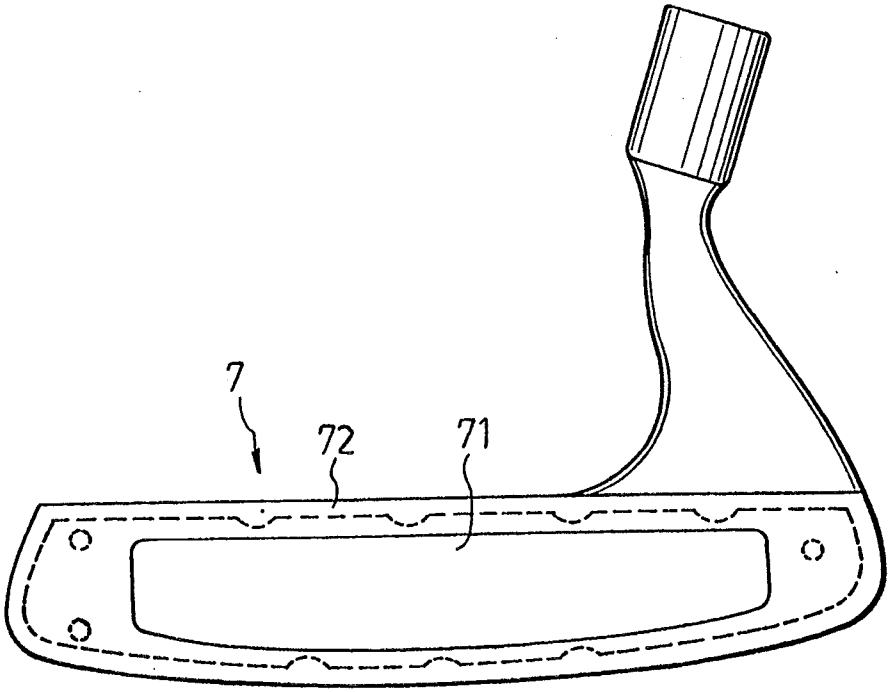
FIG. 7 is an elevational front view showing the golf club head according to the third preferred embodiment of this invention.
Figure 6:
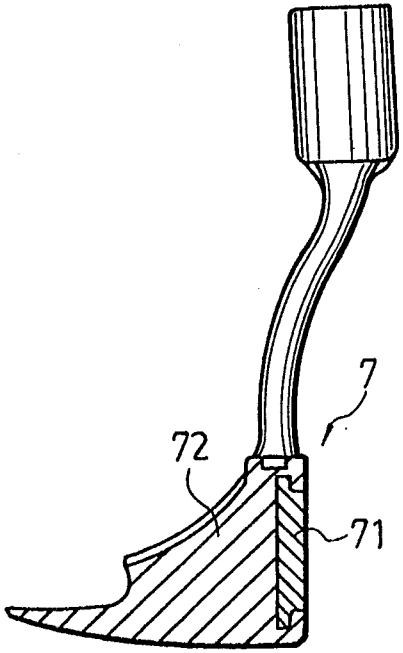
FIG. 6 is a sectional view showing the third preferred embodiment of a golf club head of this invention.

Referring to FIGS. 6 and 7, the third preferred embodiment of a golf club head 7 according to this invention is shaped so as to be applied to a putter club. The golf club head 7 consists of a face plate 71 which is made of a first metal material, and a solid head body 72 which is made of a second metal material with a melting point lower than that of the first metal material. The first and second metal materials are similar to those of the first embodiment. In addition, the face plate 71 is mounted securely on the solid head body 72 in a manner similar to that of the second embodiment, and the golf club head 7 has the same advantages as those of the first or second embodiment.

While the present invention has been described in connection with what is considered the most practical and preferred embodiment, it is understood that this invention is not limited to the disclosed embodiments but is intended to cover various arrangements included within the spirit and scope of the broadest interpretations and equivalent arrangement.

I claim:

1. A golf club head comprising:

a face plate which is made of a first metal material and which has a front side formed with a hitting surface, a rear side opposite to said front side, a flange projecting from a periphery of said face plate adjacent to said rear side, and a shoulder formed on said periphery of said face plate along and anterior to said flange; and a head body which is made of a second metal material with a melting point lower than that of said first metal material, said head body having a front portion which has a recess formed therein for receiving said face plate, a peripheral edge defining said recess, and an engagement means formed integrally with said front portion in said peripheral edge and engaged intimately and precisely with said flange and said shoulder of said face plate during molding of said head body, said engagement means having a groove extending along said peripheral edge and engaging said flange of said face plate so as to retain said face plate on said head body to form said golf club head.

2. A golf club head as claimed in claim 1, wherein said flange of said face plate has several spaced notches formed in a periphery thereof and several holes formed therethrough, said engagement means of said head body further having a plurality of connecting portions which extend respectively through said notches and said holes of said flange for further retaining said flange of said face plate within said groove of said head body.

3. A golf club head as claimed in claim 1, wherein said head body is a solid head body which is molded by a die casting process.

4. A golf club head as claimed in claim 3, wherein said die casting process includes the steps of:

(1) placing said face plate in a mold for forming said solid head body;

(2) injecting said second metal material in its molten state into said mold to form said solid head body which has said engagement means formed integrally therewith for engaging said face plate; and (3) removing said solid head body from said mold to form said golf club head..

5. A golf club head as claimed in claim 1, wherein said head body is a hollow head body which is molded by a lost wax process.

6. A golf club head as claimed in claim 5, wherein said lost wax process includes the steps of:

(1) placing said face plate in a mold for forming said hollow head body;

(2) injecting molten wax into said mold to form a hollow wax body with said face plate attached thereto;

(3) removing said hollow wax body from said mold;

(4) coating a layer of refractory material on the surface of said hollow wax body to form a refractory mold surrounding said hollow wax body;

(5) injecting said second metal material in its molten state into said refractory mold to replace said hollow wax body with said second metal material, said second metal material forming said hollow head body which has said engagement means formed integrally therewith for engaging said face plate; and (6) removing said hollow head body from said refractory mold to form said golf club head.

7. A golf club head as claimed in claim 1, wherein said first metal material is selected from the group consisting of titanium and stainless steel, said second metal material being selected from the group consisting of copper and aluminum.

* * * * *